US008297598B2

(12) United States Patent
Chen

(10) Patent No.: US 8,297,598 B2
(45) Date of Patent: Oct. 30, 2012

(54) SIMPLE START DIAPHRAGM CARBURETOR

(76) Inventor: Qi An Chen, Ruian (CN)

( * ) Notice: Subject to any disclaimer, the term of this patent is extended or adjusted under 35 U.S.C. 154(b) by 281 days.

(21) Appl. No.: 12/839,394

(22) Filed: Jul. 19, 2010

(65) Prior Publication Data

US 2011/0316176 A1 Dec. 29, 2011

(30) Foreign Application Priority Data

Jun. 23, 2010 (CN) ..... 2010 1 0207698

(51) Int. Cl.
*F02M 1/02* (2006.01)

(52) U.S. Cl. ..... 261/35; 261/52; 261/64.6; 261/65

(58) Field of Classification Search ..... 261/35, 261/52, 64.1, 64.6, 65
See application file for complete search history.

(56) References Cited

U.S. PATENT DOCUMENTS 3,907,945 A * 9/1975 Kobayashi et al. ..... 261/52
3,948,240 A * 4/1976 Hirosawa et al. ..... 123/179.16
3,962,379 A * 6/1976 Freismuth et al. ..... 261/39.3
4,200,595 A * 4/1980 Dye ..... 261/39.3
4,983,330 A * 1/1991 Harbeke ..... 261/52
6,394,424 B2 * 5/2002 Pattullo et al. ..... 261/35
6,698,727 B1 * 3/2004 Shaw ..... 261/35
7,337,757 B2 * 3/2008 Schmidt et al. ..... 123/179.16
2001/0048167 A1 * 12/2001 Pattullo et al. ..... 261/35
2006/0043620 A1 * 3/2006 Roth et al. ..... 261/52
2010/0237516 A1 * 9/2010 Kern et al. ..... 261/64.6

FOREIGN PATENT DOCUMENTS

JP 52-53147 A * 4/1977

* cited by examiner

*Primary Examiner* — Richard L Chiesa

(57) ABSTRACT

A simple start diaphragm carburetor includes a carburetor body, a main adjutage, a throttle subassembly, a choke spindle, a linkage subassembly and a start fuel passage. The linkage subassembly includes a first linkage subassembly, a reset element and a second linkage subassembly which cooperates with the first eccentric element to form a linkage. When the first linkage subassembly opens the start fuel passage, the second linkage subassembly drives the main fuel supply channel to be open partially. Rotate the throttle subassembly and the choke spindle is reset by the reset element, thereby closing the start fuel passage. The simple start diaphragm carburetor can increase the probability of the successful start of an engine and keep the engine warmed-up for a long time, and reduce the burden of the user.

8 Claims, 15 Drawing Sheets

1

SIMPLE START DIAPHRAGM CARBURETOR

FIELD OF THE INVENTION

The present invention relates to a carburetor, and more particularly to a simple start diaphragm carburetor with simple operation which can increase the probability of the successful start of an engine and cause the engine to be kept warm-up for a long time at a high density fuel state.

BACKGROUND OF THE INVENTION

With the improvement of the society and the development of the economic, the general gasoline engine industry is provided with a good development platform. And the booming general gasoline engine industry further accelerates the development of its accessorial industries, one of which is the carburetor industry.

A carburetor is a equipment that mixes a certain amount of fuel and some air to keep the engine working normally, so as to prevent the engine from stopping work or damage under a "lacking fuel" condition, which is caused by that no sufficient fuel can be mixed with the air, and in turn, make the engine work more reliably and safely. Meanwhile, the carburetor monitors whether superfluous fuel is mixed with the air so as to insure the proportion of the mixed fuel and air and, in turn, prevent the engine from working under a "rich fuel" condition, which may cause the engine to stop working, generate a lot of smoke, and work in bad condition or waste fuel. Thus, the carburetor works as a head of an engine, and the performance of the carburetor plays an important role in the performance of the engine. Therefore, choosing a good carburetor is one of key factors to bring the engine into full play. However, the existing diaphragm carburetors have the following drawbacks:

As illustrated in FIG. 1 and FIG. 2, an existing diaphragm carburetor includes a carburetor body 21, a main adjutage 22, a throttle subassembly 23 and a choke subassembly 24. The carburetor body 21 is formed to be a main fuel supply channel which includes a gas inlet cavity 210*a*, a venturi 210*b* and a mixing cavity 210*c*. The main adjutage 22 is disposed on the venturi 210*b*. The throttle subassembly 23 includes a throttle spindle 231 pivoted to the carburetor body 21 and a throttle 232 mounted on the throttle spindle 231 for opening or closing the mixing cavity 210*c*. The choke subassembly 24 includes a choke spindle 241 pivoted to the carburetor body 21 and a choke 242 mounted on the choke spindle 241 for opening or closing the gas inlet cavity 210*a*. When starting, rotate the choke spindle 241 to make the choke 242 close the gas inlet cavity 210*a*, as the state shown in FIG. 1, at this time, the choke 242 prevents outer air from entering the venturi 210*b*, so as to cause the engine to start at a high density fuel state thereby increasing the probability of the successful start of the engine. After the engine starting, it is necessary to rotate the choke spindle 241 by manual means in a very short time to cause the choke 242 to fixedly connect with the choke spindle 241 thereby opening the gas inlet cavity 210*a*, as the state shown in FIG. 2, at this time, the outer air enters the venturi 210*b* in the direction of arrow shown in the gas inlet cavity 210*a* so as to meet the need of the engine for working normally.

However, aforementioned diaphragm carburetor needs to rotate the choke spindle 241 by manual means in a very short time to cause the choke 242 to open after the engine starting, otherwise the engine will flameout in a short time. On one hand, it is not convenient for the operation of the user, thereby increasing the burthen of the user. On the other hand, when the engine want to run for a long time to meet the need of warm-up, it needs to provide small hole formed in the choke 242 for more air entering, however, this will decrease the degree of vacuum at the main adjutage 22, the fuel ejected from the main adjutage 22 is not enough to mix with the air, thus the output mixed gas is so sparse that the engine can not start normally.

SUMMARY OF THE INVENTION

Accordingly, an object of the present invention is to provide a simple start diaphragm carburetor. On one hand, this simple start diaphragm carburetor is capable of increasing the probability of the successful start of the engine so as to make the engine maintain a prolonged running at a high intensity fuel state to meet the need of warn-up of the engine. On the other hand, when the engine is working normally, this simple start diaphragm carburetor can be automatically reset to an original state with an admixture of fuel and air, thereby reducing the burden of the user.

To achieve the above-mentioned object, the present invention provides a simple start diaphragm carburetor including a carburetor body, a main adjutage, a throttle subassembly, a rounded choke spindle, a linkage subassembly and a start fuel passage for starting. The carburetor body is formed to be a main fuel supply channel which includes a gas inlet cavity, a venturi and a mixing cavity. The main adjutage is mounted on the venturi. The throttle subassembly includes a throttle and a throttle spindle, the throttle is mounted in the mixing cavity and fixedly connects with the throttle spindle which is pivoted to the carburetor body hermetically, and two ends of the throttle spindle protrude from the carburetor body to form a linkage end and a mounting end, respectively. The choke spindle is hermetically pivoted to a part of the carburetor body located at the gas inlet cavity, and two ends of the choke spindle protrude from the carburetor body to form a linkage end and a fixing end, respectively. The start fuel passage is provided in the carburetor body and the carburetor body further provides a measuring room therein. The start fuel passage has a fuel inlet connecting with the measuring room and a fuel outlet connecting with the mixing cavity. The linkage subassembly includes a first linkage subassembly, a second linkage subassembly and a reset element. The carburetor body further includes a receiving cavity which connects with the start fuel passage. The first linkage subassembly is contained in the receiving cavity smoothly and hermetically. One end of the first linkage subassembly is elastically pressed against a part of the carburetor body which is in the receiving cavity, and the other end of the first linkage subassembly is pressed against the choke spindle. The second linkage subassembly includes a first eccentric element mounted on the linkage end of the choke spindle and a second eccentric element fixed on the linkage end of the throttle spindle, the second eccentric element cooperates with the first eccentric element to form a linkage, the reset element is pressed between the first eccentric element and the carburetor body. Start and rotate the choke spindle to cause the first linkage subassembly to open the start fuel passage and cause the second linkage subassembly to open the main fuel supply channel partially, rotate the throttle spindle to cause the choke spindle to be reset by the reset element thereby closing the start fuel passage.

Preferably, the first eccentric element of the second linkage subassembly has a protuberant pushing portion, and the second eccentric element has a cambered resisting portion cooperating with the pushing portion to form a linkage. Based on the cooperation of the pushing portion and the resisting portion, when the choke spindle opens the start fuel passage, the choke spindle also drives the throttle spindle to rotate by the second linkage subassembly, the rotating throttle spindle drives the throttle to open the main fuel supply channel partially so as to cause the engine to start at a high intensity fuel state. After starting, the pushing portion and the resisting portion make the engine maintain run at a high intensity fuel state to meet the need of a prolonged warn-up of the engine after starting. Concretely, the pushing portion is a column and the resisting portion is step shaped. Thus, the pushing portion and resisting portion can work more reliably, and it is convenient to the manufacture of the pushing portion and resisting portion.

Preferably, the first eccentric element of the second linkage subassembly has a cambered locating slot formed therein, the carburetor body has a locating column corresponding to the locating slot, and the locating column extends into the locating slot. Based on aforementioned locating slot and locating column, the choke spindle can open or close the start fuel passage exactly, and good condition for the throttle to open the main fuel supply channel exactly is provided.

Preferably, the first linkage subassembly comprises a elastic element and a valve body, one end of the elastic element is pressed against the part of the carburetor body which is in the receiving cavity, the other end of the elastic element is pressed against one end of the valve body which is contained in the receiving cavity smoothly and hermetically, the other end of the valve body is pressed against the choke spindle which has a upper position pressed against the valve body to close the start fuel passage and a lower position pressed against the valve body to open the start fuel passage. Due to the first linkage subassembly is composed by the elastic element and the valve body, the first linkage subassembly has compact structure, reliable working and low cost. Based on the upper position and lower position which are both set on aforementioned choke spindle, opening or closing the start fuel passage is realized. Concretely, the choke spindle has a hollow plane formed within, and the distance from the hollow plane to the axes of the choke spindle is smaller than the distance from the rounded surface of the choke spindle to the axes of the choke spindle thereby forming the upper position and the lower position, respectively. The hollow plane is convenient for forming the upper position and lower position on the choke spindle.

Preferably, the reset element is a spring, thus the reset element has simple structure and it is functional.

Preferably, the simple start diaphragm carburetor further includes a starting handle which is fixed on the fixing end of the choke spindle. Based on the starting handle, the operation of rotating the choke spindle is easy to do by the user.

In comparison with the prior art, the simple start diaphragm carburetor of the present invention further includes the start fuel passage, the first linkage subassembly, the second linkage subassembly and the reset element. When the engine starting, the choke spindle opens the start fuel passage by the first linkage subassembly, and at the same time, also drives the throttle spindle to rotate by the second linkage subassembly, while the rotating throttle spindle drives the throttle to open the main fuel supply channel partially, so as to cause the engine to start at a high intensity fuel state, thereby increasing the probability of the successful start of the engine. After starting, the second linkage subassembly makes the choke spindle and the throttle spindle maintain an original state, such that the main fuel supply channel is maintained at a partial open state and the start fuel passage is maintained at an open state. Thus, the air can enter the main fuel supply channel without any limitation, thereby meeting the need of a prolonged warn-up of the engine after starting. When rotating the throttle spindle to make it open the main fuel supply channel to meet the need of normal work of the engine, the second eccentric element which is fixed with the linkage end of the throttle spindle is divorced from the linkage with the first eccentric element, the first eccentric element divorced from the linkage is reset automatically under the effect of the reset element, thus the trouble produced by exciting diaphragm carburetor that it needs to rotate the choke spindle by manual means after the engine starting is avoided, thereby reducing the burden of the user.

BRIEF DESCRIPTION OF THE DRAWINGS

FIGS. 5*a*-5*e* are schematic diagrams illustrating the work flow of the simple start diaphragm carburetor shown in FIG. 3 when its start fuel passage is open;

DETAILED DESCRIPTION OF ILLUSTRATED EMBODIMENTS

Figure 1:
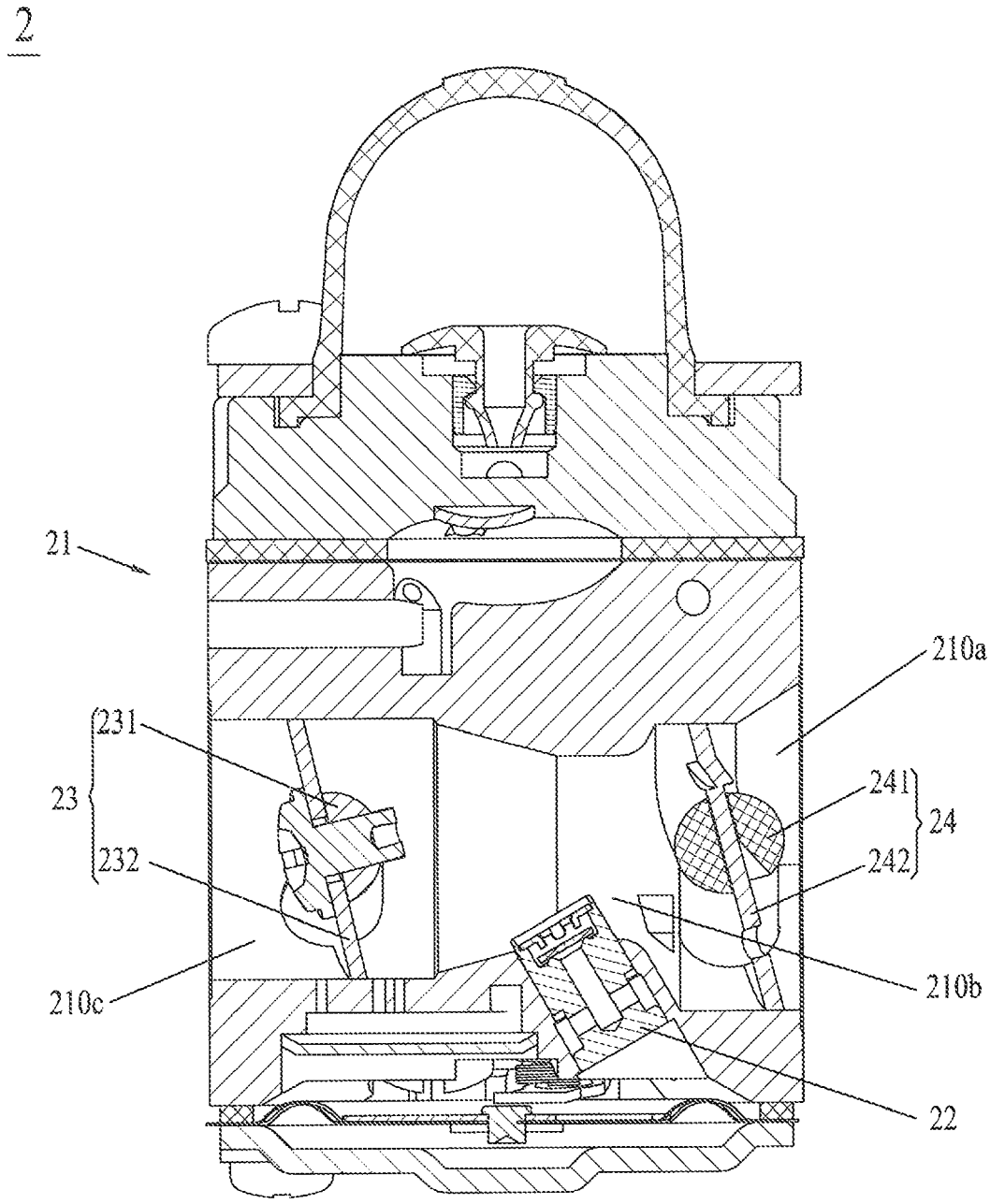
Fig. 1 (PRIOR ART)
FIG. 1 is a state diagram of an existing diaphragm carburetor when an engine starts.
Figure 2:
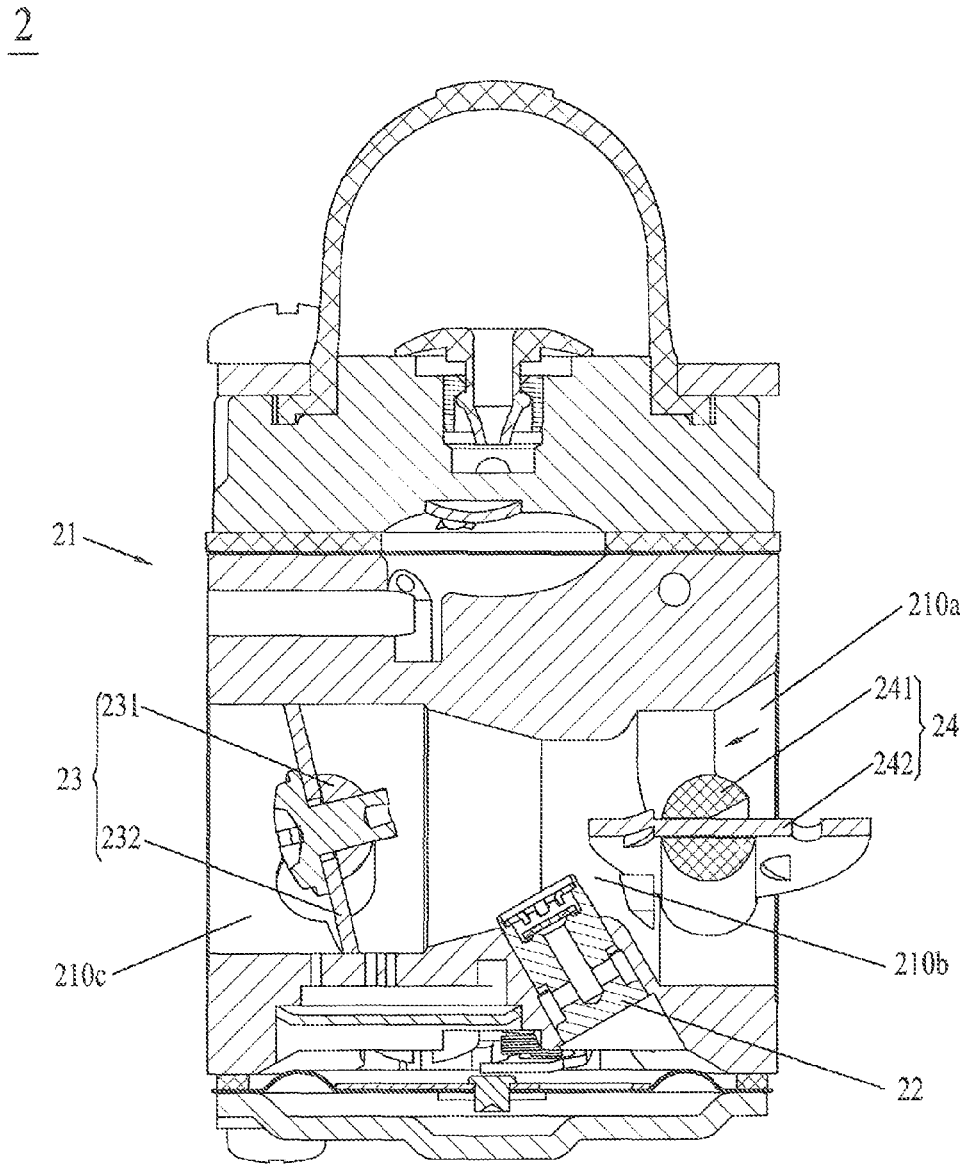
Fig. 2 (PRIOR ART)
FIG. 2 is another state diagram of the existing diaphragm carburetor shown in FIG. 1 when the engine works normally.

In order to expatiate the technical solution to achieve the objects of the present invention further, an explanatory embodiment of the present invention and its features and advantages will now be described with reference to the Figures, wherein like reference numerals designate similar parts throughout the various views.

Figure 3:
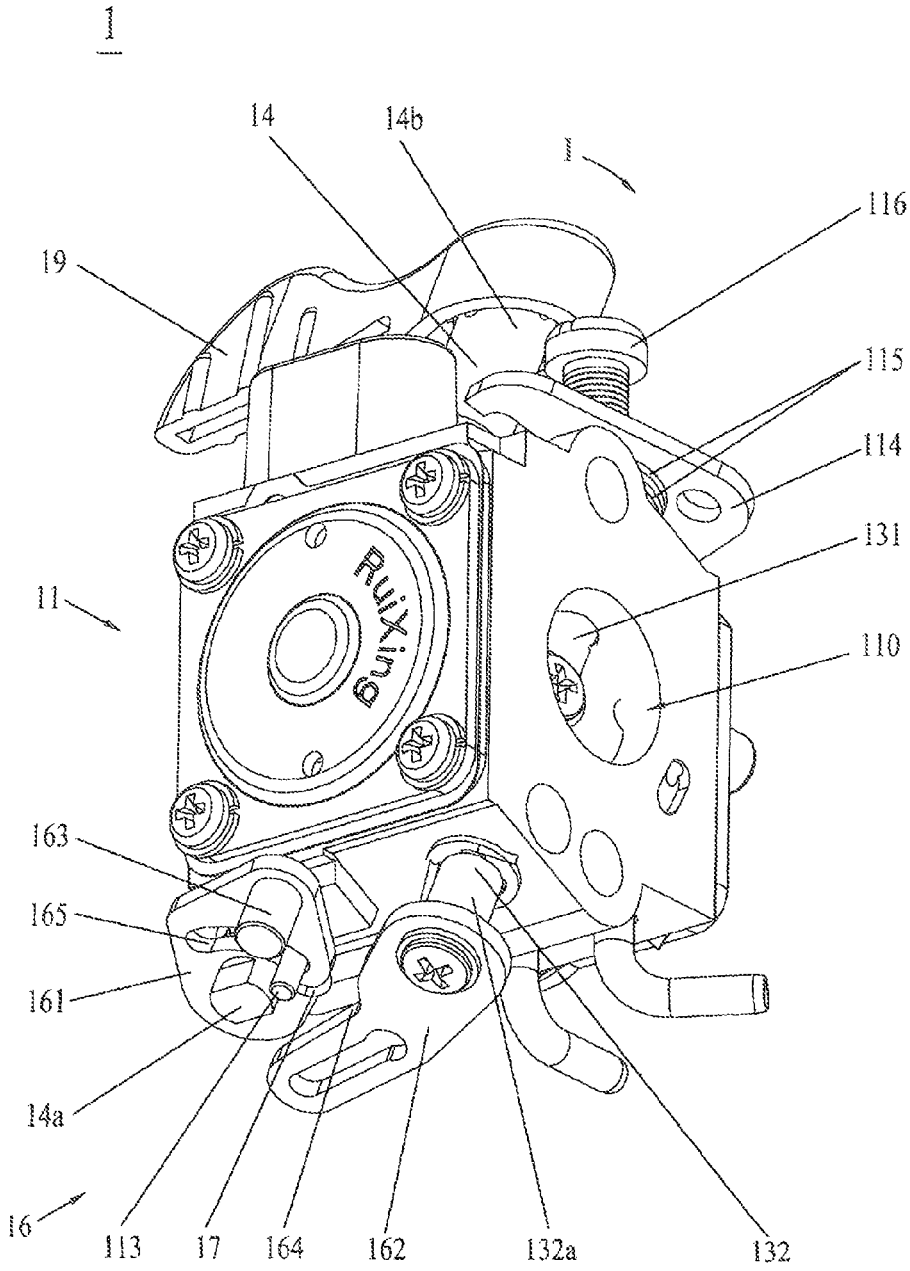
FIG. 3 is a perspective view of a simple start diaphragm carburetor according to an embodiment of the present invention.
Figure 4:
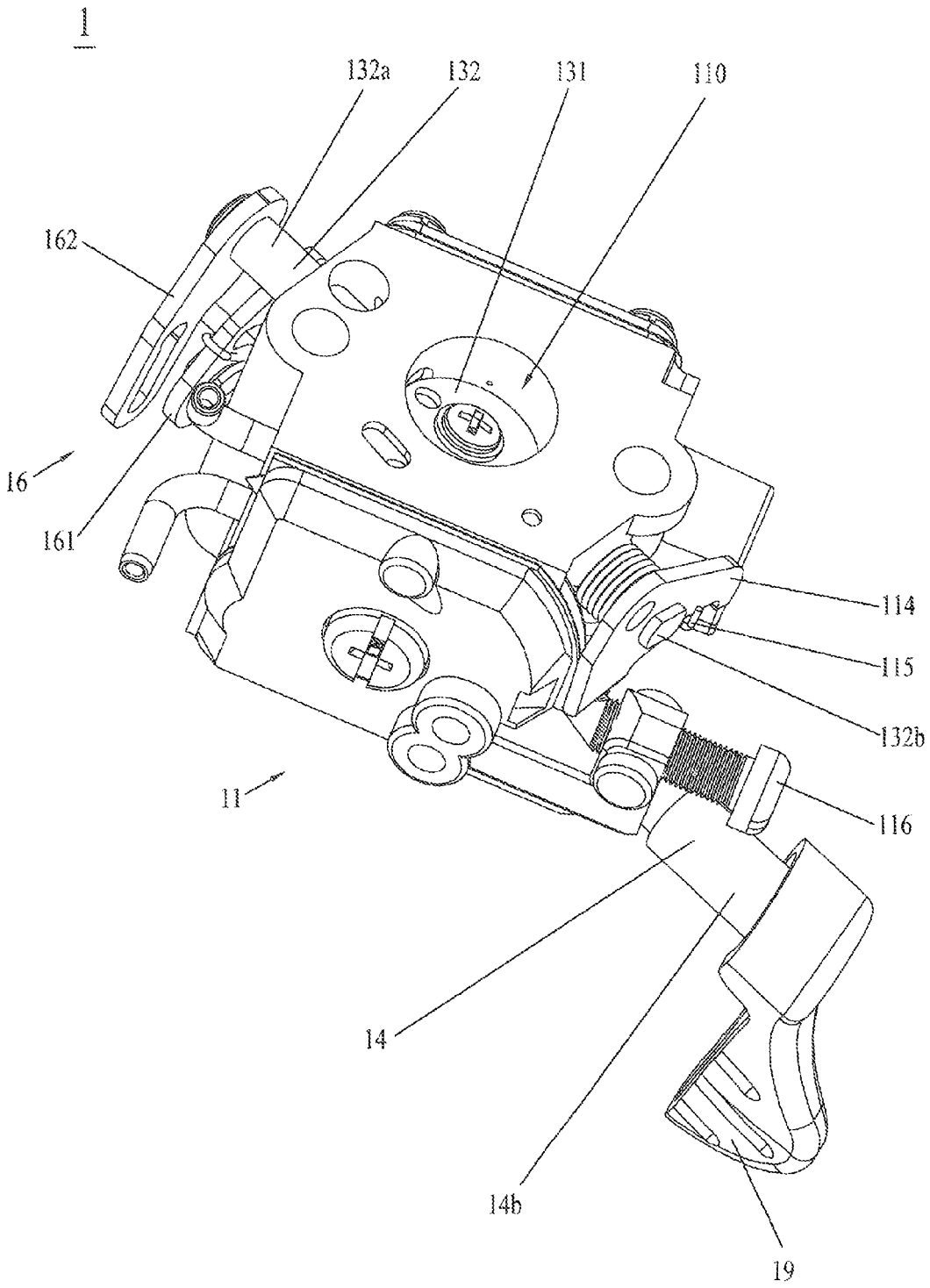
FIG. 4 is another perspective view of the simple start diaphragm carburetor shown in FIG. 3.
Figure 5A:
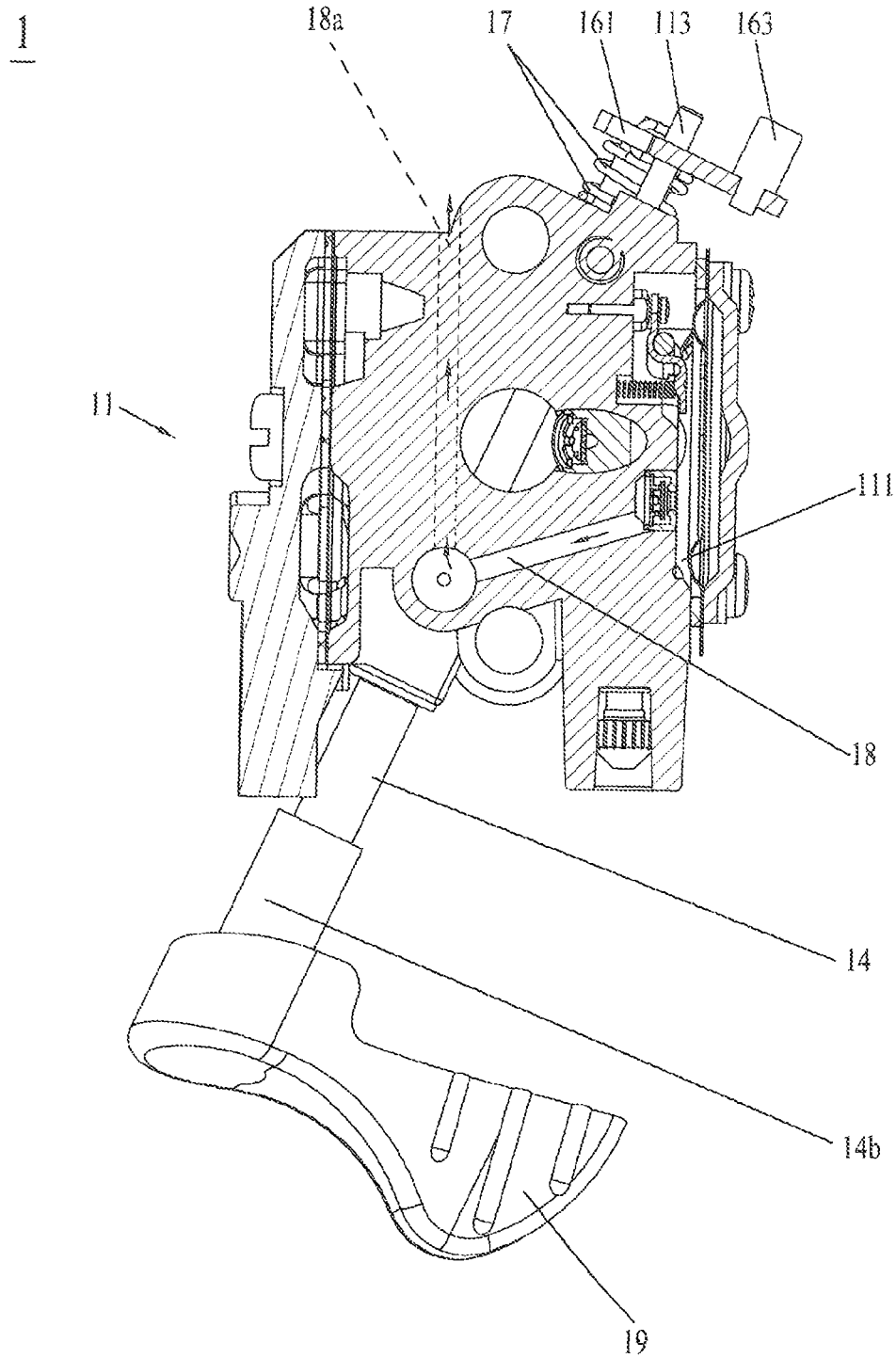
Figure 5B:
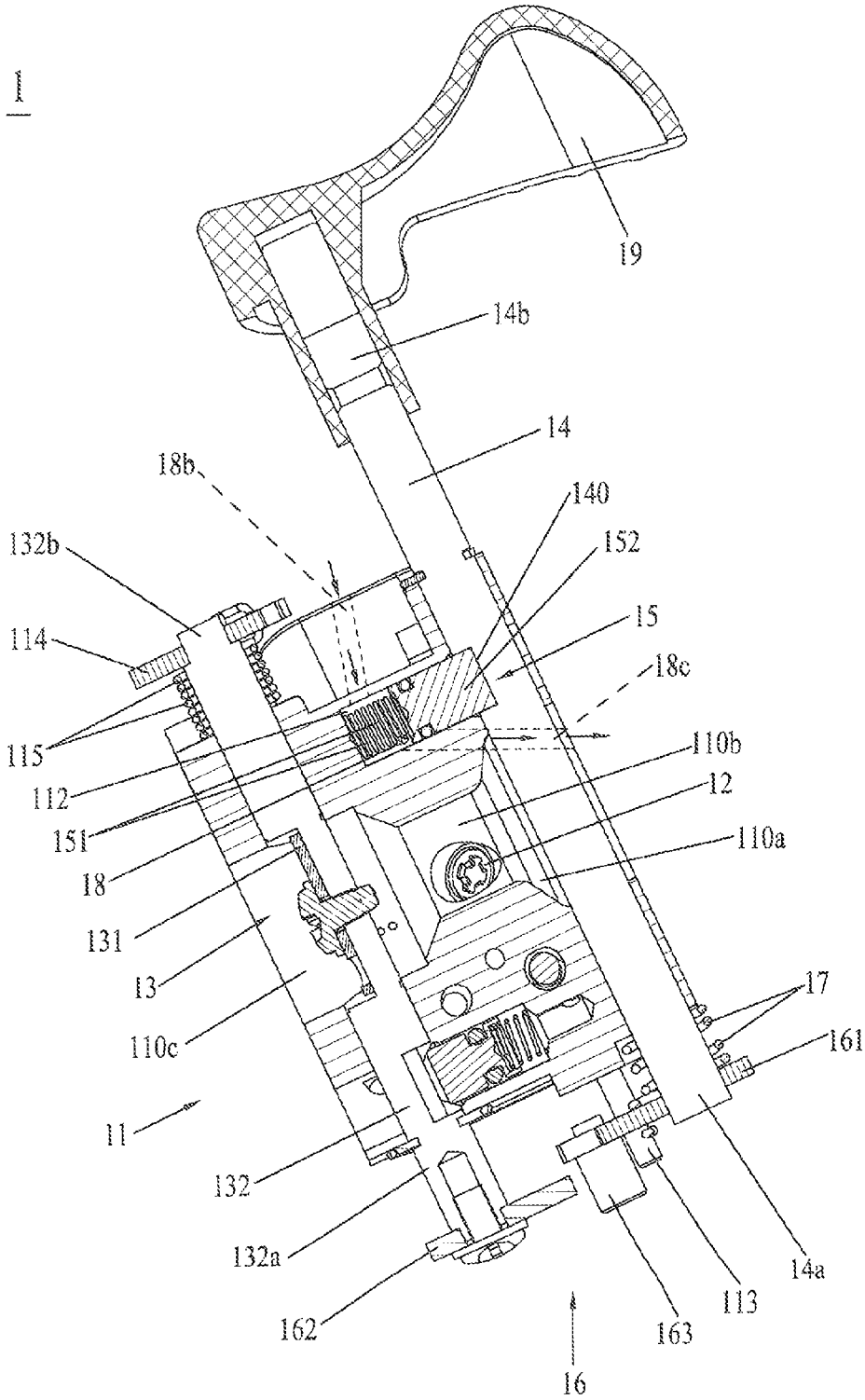

Referring to FIG. 3-4 and FIGS. 5*a*-5*b*, a simple start diaphragm carburetor 1 as an embodiment of the present invention includes a carburetor body 11, a main adjutage 12, a throttle subassembly 13, a rounded choke spindle 14, a linkage subassembly and a start fuel passage 18 for starting. The carburetor body 11 is formed to be a main fuel supply channel 110 which orderly includes a gas inlet cavity 110*a*, a venturi 110*b* and a mixing cavity 110*c*. The main adjutage 12 is mounted on the venturi 110*b*. The throttle subassembly 13 includes a throttle 131 and a throttle spindle 132. The throttle 131 is mounted in the mixing cavity 110*c* and fixedly connects with the throttle spindle 132 by a screw. While the throttle spindle 132 is pivoted to the carburetor body 11 hermetically such that the throttle spindle 132 can rotate around the carburetor body 11 and the connection of the throttle spindle 132 and the carburetor body 11 is airproof. Two ends of the throttle spindle 132 protrude from the carburetor body 11 to form a linkage end 132*a* and a mounting end 132*b*, respectively. The choke spindle 14 is hermetically pivoted to a part of the carburetor body 11 located at the gas inlet cavity 110*a*, such that the choke spindle 14 can rotate around the carburetor body 11 and the connection of the choke spindle 14 and the carburetor body 11 is airproof. Two ends of the choke spindle 14 protrude from the carburetor body 11 to form a linkage end 14*a* and a fixing end 14*b*, respectively. The start fuel passage 18 is provided in the carburetor body 11 and the carburetor body 11 further provides a measuring room 111 therein. The start fuel passage 18 has a fuel inlet connecting with the measuring room 111 and a fuel outlet connecting with the mixing cavity 110*c*. The linkage subassembly includes a first linkage subassembly 15, a second linkage subassembly 16 and a reset element 17. The carburetor body 11 further includes a receiving cavity 112 which connects with the start fuel passage 18. The first linkage subassembly 15 is contained in the receiving cavity 112 smoothly and hermetically (that is the first linkage subassembly 15 can slip in the receiving cavity 112 and prevent the receiving cavity 112 from connecting with outside environment). One end of the first linkage subassembly 15 is elastically pressed against a part of the carburetor body 11 which is in the receiving cavity 112, and the other end of the first linkage subassembly 15 is pressed against the choke spindle 14. The second linkage subassembly 16 includes a first eccentric element 161 and a second eccentric element 162. The first eccentric element 161 is mounted on the linkage end 14*a* of the choke spindle 14 and the second eccentric element 162 is fixed on the linkage end 132*a* of the throttle spindle 132. The second eccentric element 162 cooperates with the first eccentric element 161 to form a linkage. The reset element 17 is pressed between the first eccentric element 161 and the carburetor body 11. Start and rotate the choke spindle 14 to cause the first linkage subassembly 15 to open the start fuel passage 18, at the same time, the choke spindle 14 drives the throttle spindle 132 to rotate discontinuously by the second linkage subassembly 16, the rotating throttle spindle 132 drives the throttle 131 to open the main fuel supply channel 110 partially so as to meet the need of high intensity fuel when the engine starting. After starting, rotate the throttle spindle 132, drive the throttle 131 to maintain that the main fuel supply channel 110 is open and make the second eccentric element 162 which is fixed with the linkage end 132*a* of the throttle spindle 132 be divorced from the linkage with the first eccentric element 161. The first eccentric element 161 divorced from the linkage drives the choke spindle 14 to be reset by the reset element 17, and then, the choke spindle 14 drives the first linkage subassembly 15 to close the start fuel passage 18 so as to meet the need of normal work of the engine. Wherein, in order to rotating the choke spindle 14 more handily by the user, a starting handle 19 is mounted on the fixing end 14*b* of the choke spindle 14; in order to automatically reset the throttle spindle 132 which drives the throttle 131 to open the main fuel supply channel 110, a swing frame 114 is mounted on the mounting end 132*b* of the throttle spindle 132, furthermore, a swing frame spring 115 is provided between the swing frame 114 and the carburetor body 11; in order to use the swing frame 114 to adjust the degree of open of the main fuel supply channel 110 opened by the throttle 131, a adjusting screw 116 is provided on the carburetor body 11, the bottom of the adjusting screw 116 is a subuliform structure which is pressed against the swing frame 114. More detailed structure will be described as follows:

Preferably, the first eccentric element 161 of the second linkage subassembly 16 has a protuberant pushing portion 163, and the second eccentric element 162 has a cambered resisting portion 164 cooperating with the pushing portion 163 to form a linkage. Based on the cooperation of the pushing portion 163 and the resisting portion 164, when the choke spindle 14 opens the start fuel passage 18, the choke spindle 14 also drives the throttle spindle 132 to rotate by the second linkage subassembly 16, the rotating throttle spindle 132 drives the throttle 131 to open the main fuel supply channel 110 partially so as to cause the engine to start at a high intensity fuel state. After starting, the pushing portion 163 and the resisting portion 164 make the engine maintain run at a high intensity fuel state to meet the need of a prolonged warn-up of the engine after starting. Concretely, the pushing portion 163 is a column and the resisting portion 164 is step shaped. Thus, the pushing portion 163 and resisting portion 164 can work more reliably, and it is convenient to the manufacture of the pushing portion 163 and resisting portion 164.

Preferably, the first eccentric element 161 of the second linkage subassembly 16 has a cambered locating slot 165 formed therein, the carburetor body 11 has a locating column 113 corresponding to the locating slot 165, and the locating column 113 extends into the locating slot 165. Based on aforementioned locating slot 165 and locating column 113, the choke spindle 14 can open or close the start fuel passage 18 exactly, and good condition for the throttle 131 to open the main fuel supply channel 110 exactly is provided.

Preferably, the first linkage subassembly 15 comprises a elastic element 151 and a valve body 152, one end of the elastic element 151 is pressed against the part of the carburetor body 11 which is in the receiving cavity 112, the other end of the elastic element 151 is pressed against one end of the valve body 152 which is contained in the receiving cavity 112 smoothly and hermetically, the other end of the valve body 152 is pressed against the choke spindle 14 which has a upper position pressed against the valve body 152 to close the start fuel passage 18 and a lower position pressed against the valve body 152 to open the start fuel passage 18. Due to the first linkage subassembly 15 is composed by the elastic element 151 and the valve body 152, the first linkage subassembly 15 has compact structure, reliable working and low cost. Based on the upper position and lower position which are both set on aforementioned choke spindle 14, opening or closing the start fuel passage 18 is realized. Concretely, the choke spindle 14 has a hollow plane formed within, and the distance from the hollow plane to the axes of the choke spindle 14 is smaller than the distance from the rounded surface of the choke spindle 14 to the axes of the choke spindle 14 thereby forming the upper position and the lower position, respectively. The hollow plane is convenient for forming the upper position and lower position on the choke spindle 14.

Preferably, the reset element 17 is a spring, thus the reset element 17 has simple structure and it is functional.

Figure 5C:
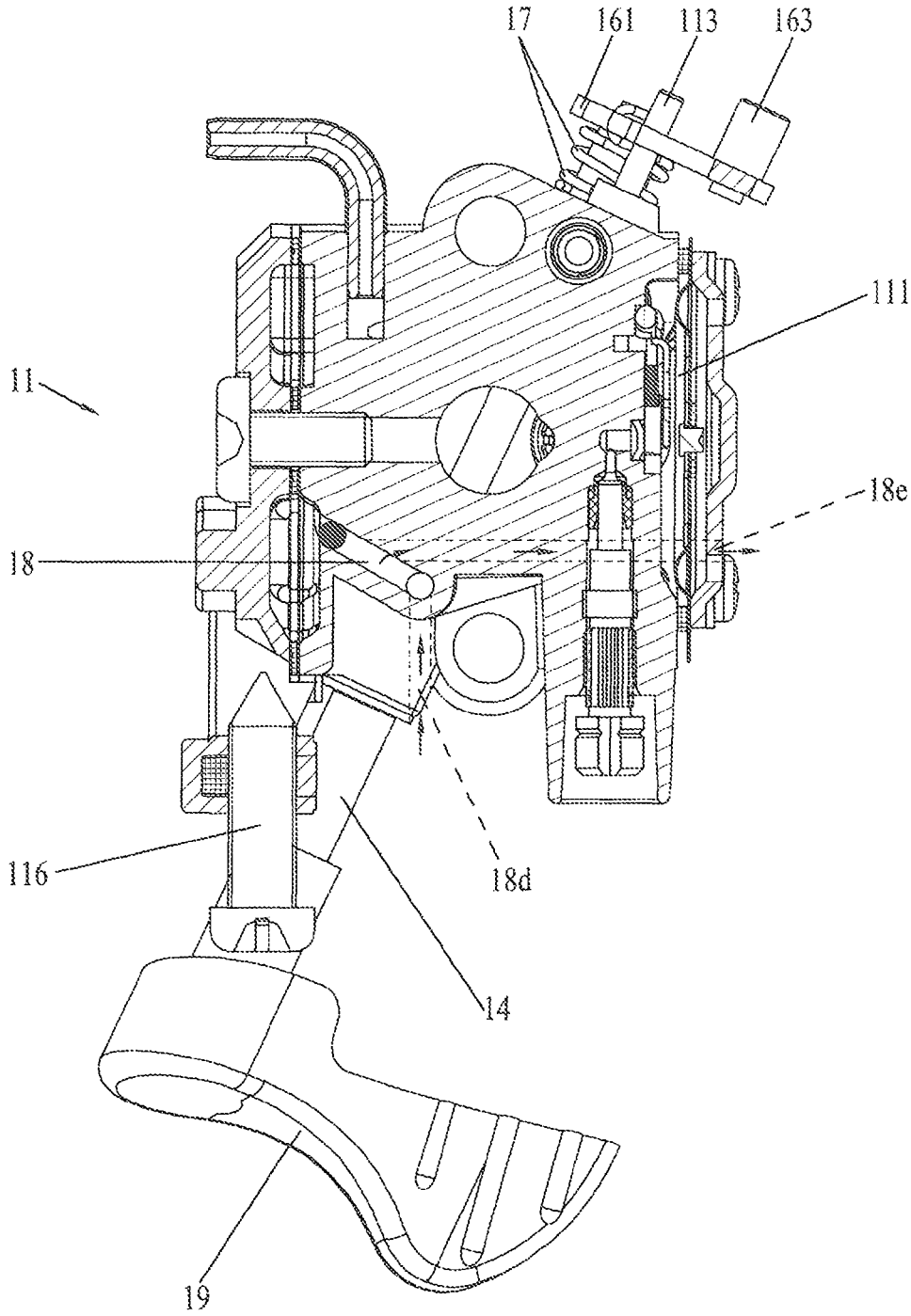
Figure 5D:
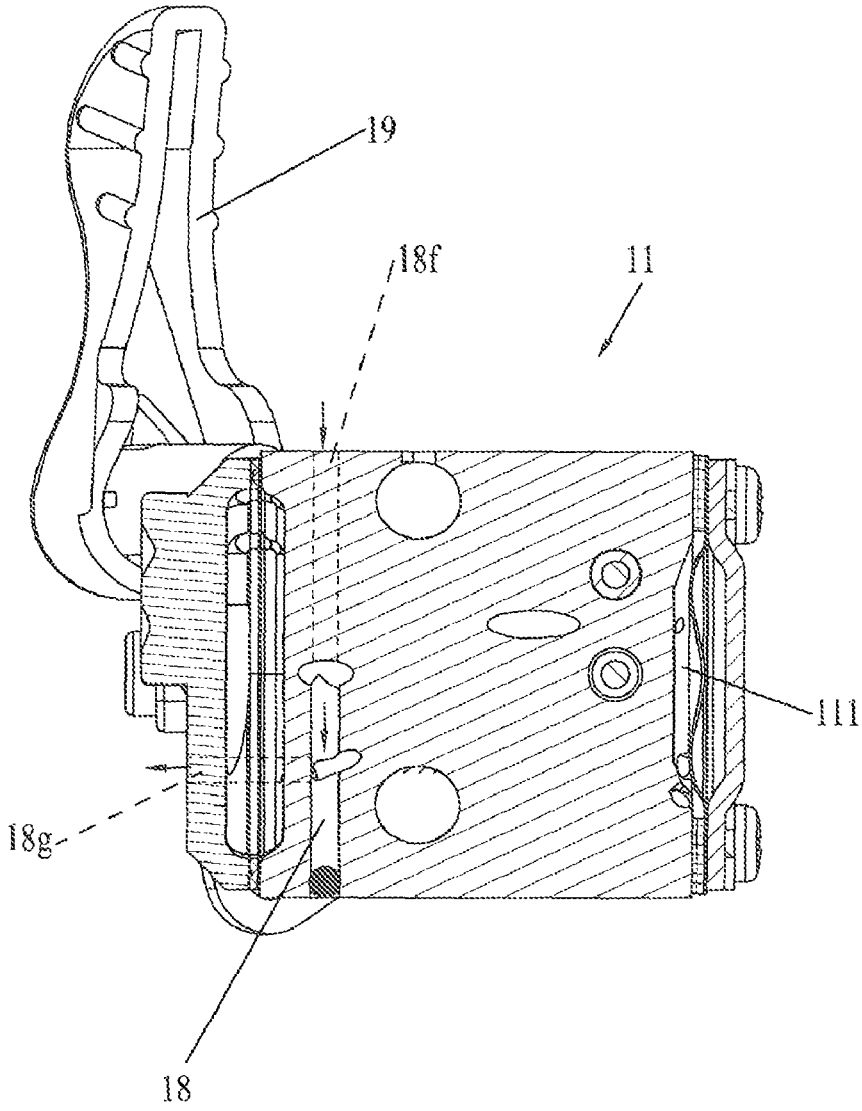
Figure 5C:
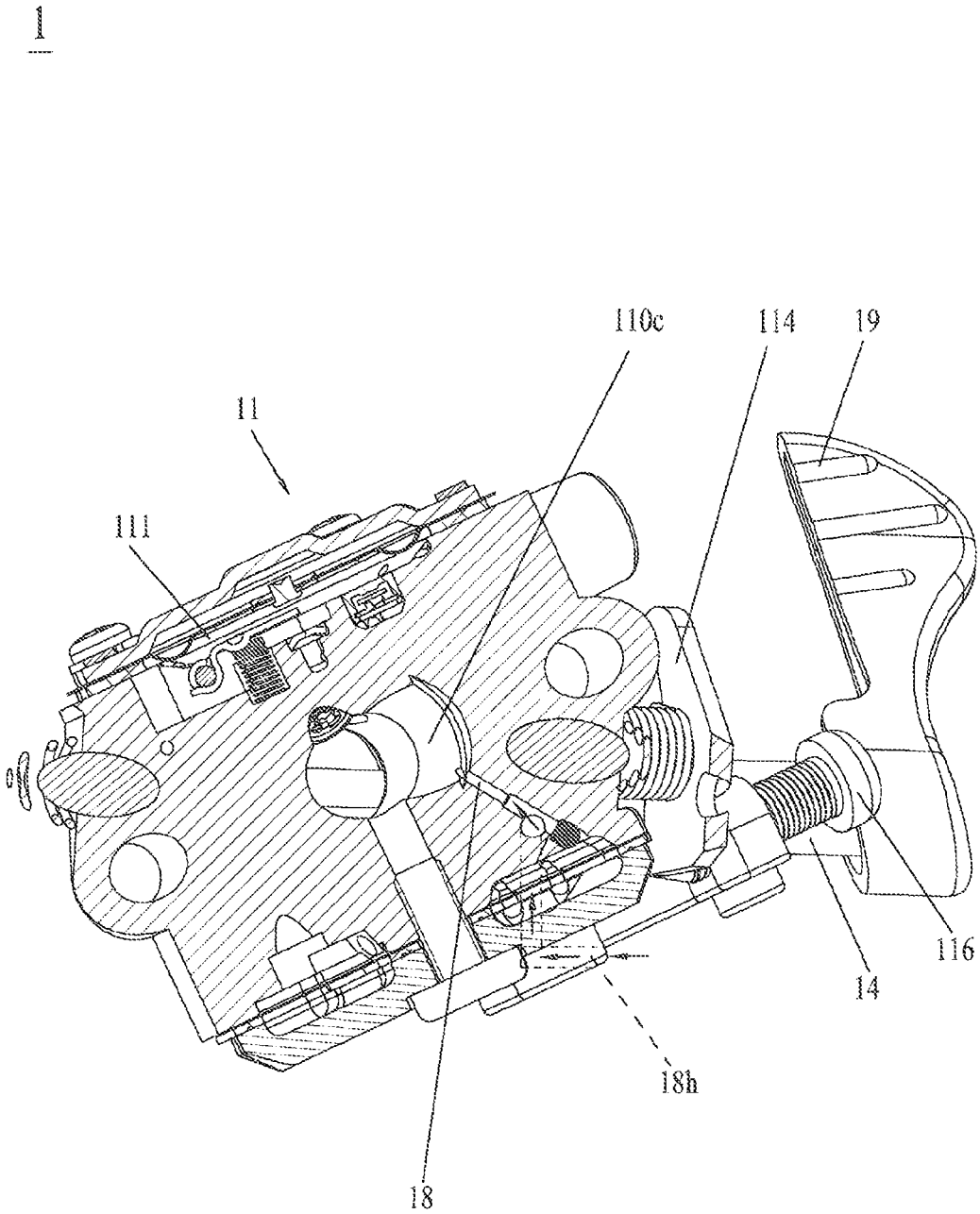
Figure 6A:
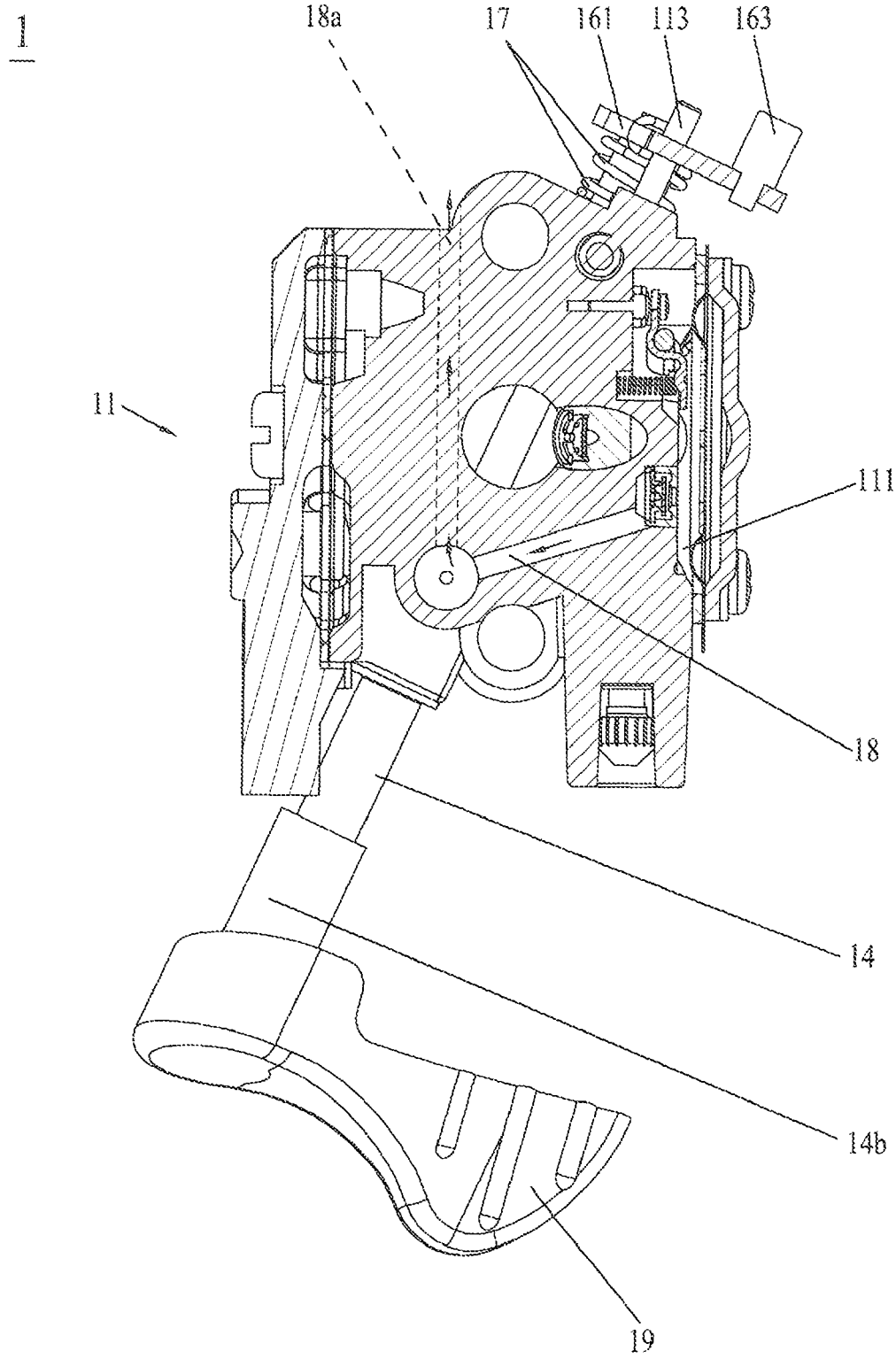
FIGS. 6*a*-6*e* are schematic diagrams illustrating the work flow of the simple start diaphragm carburetor shown in FIG. 3 when its start fuel passage is closed.
Figure 6B:
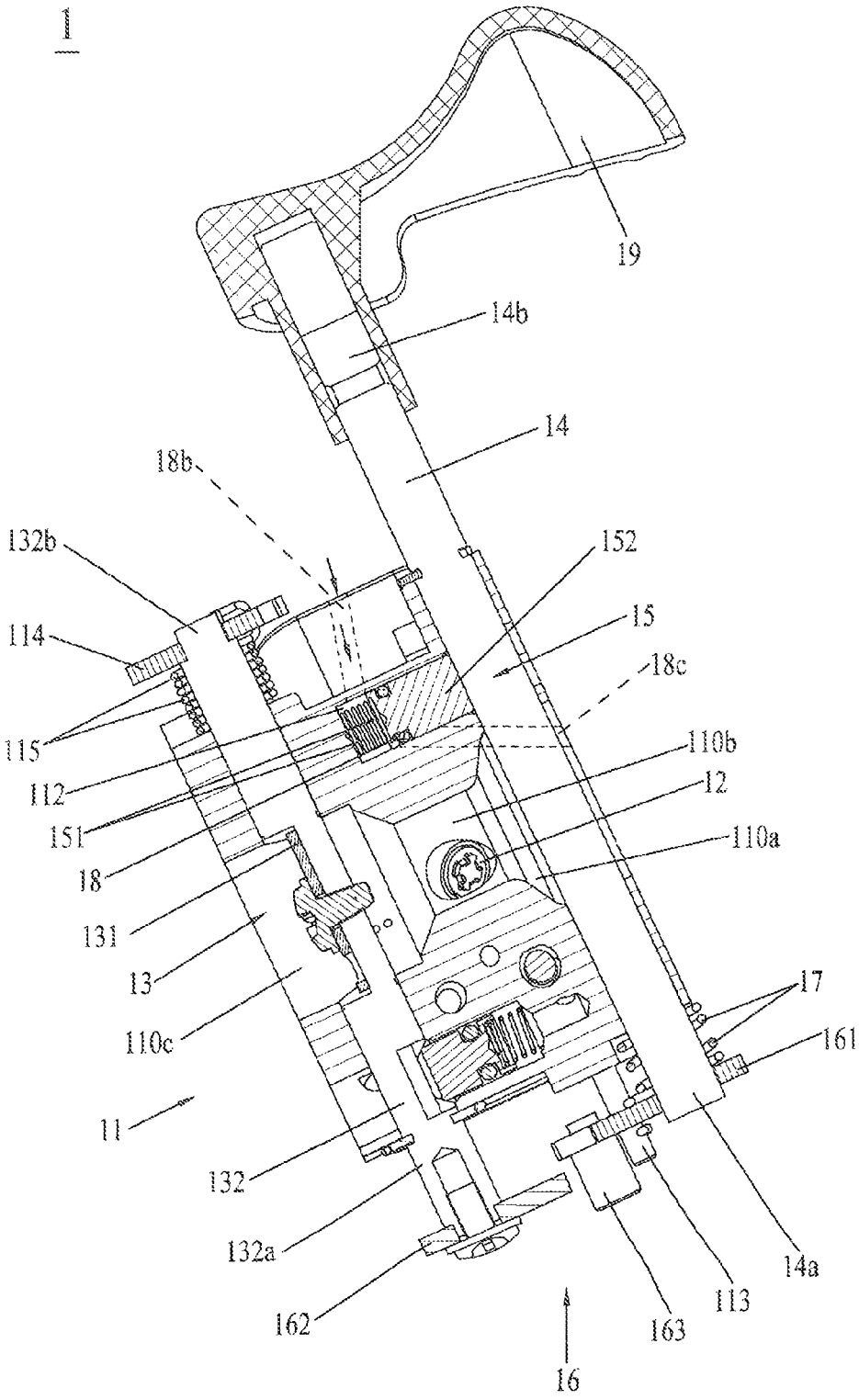
Figure 6C:
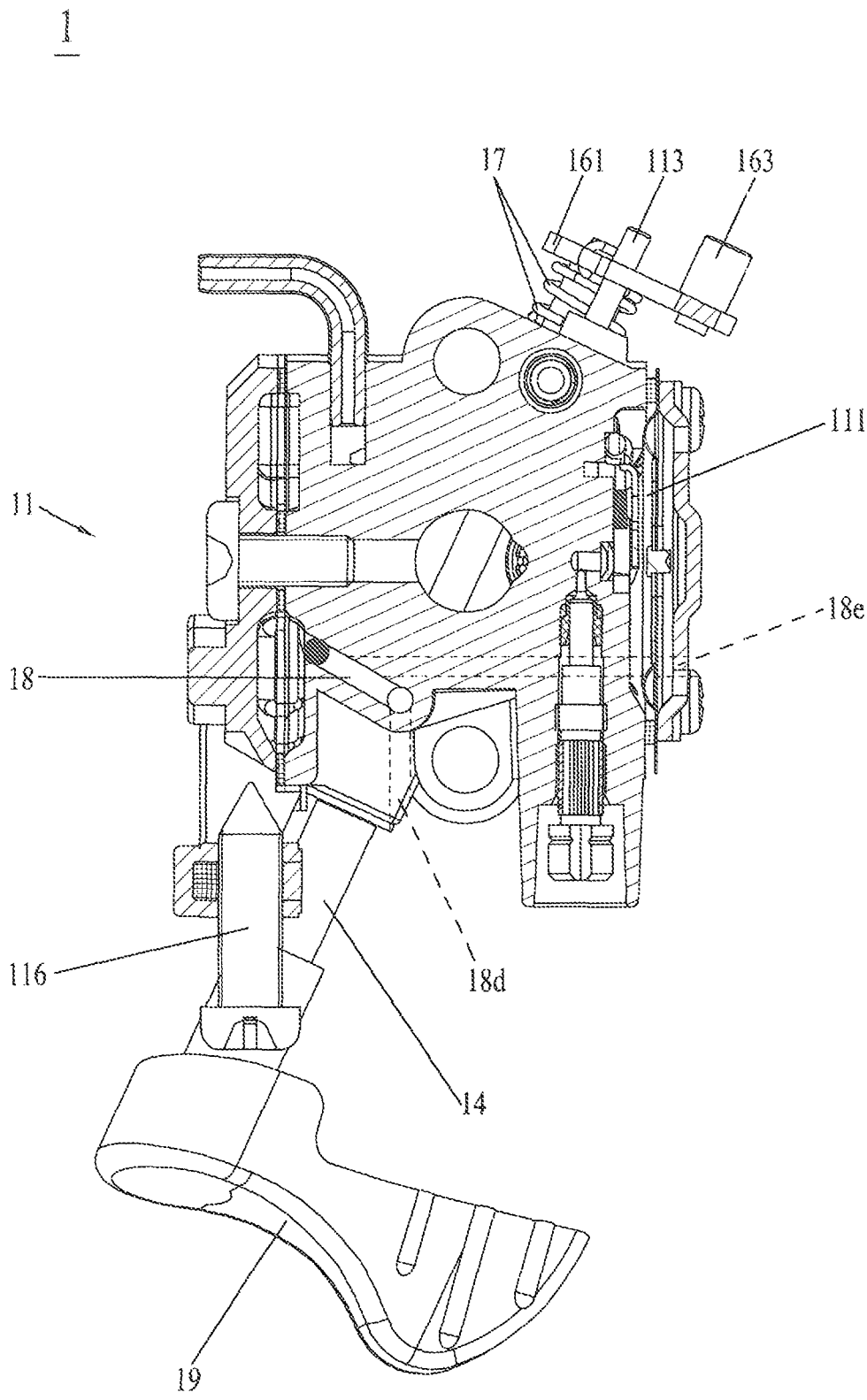
Figure 6D:
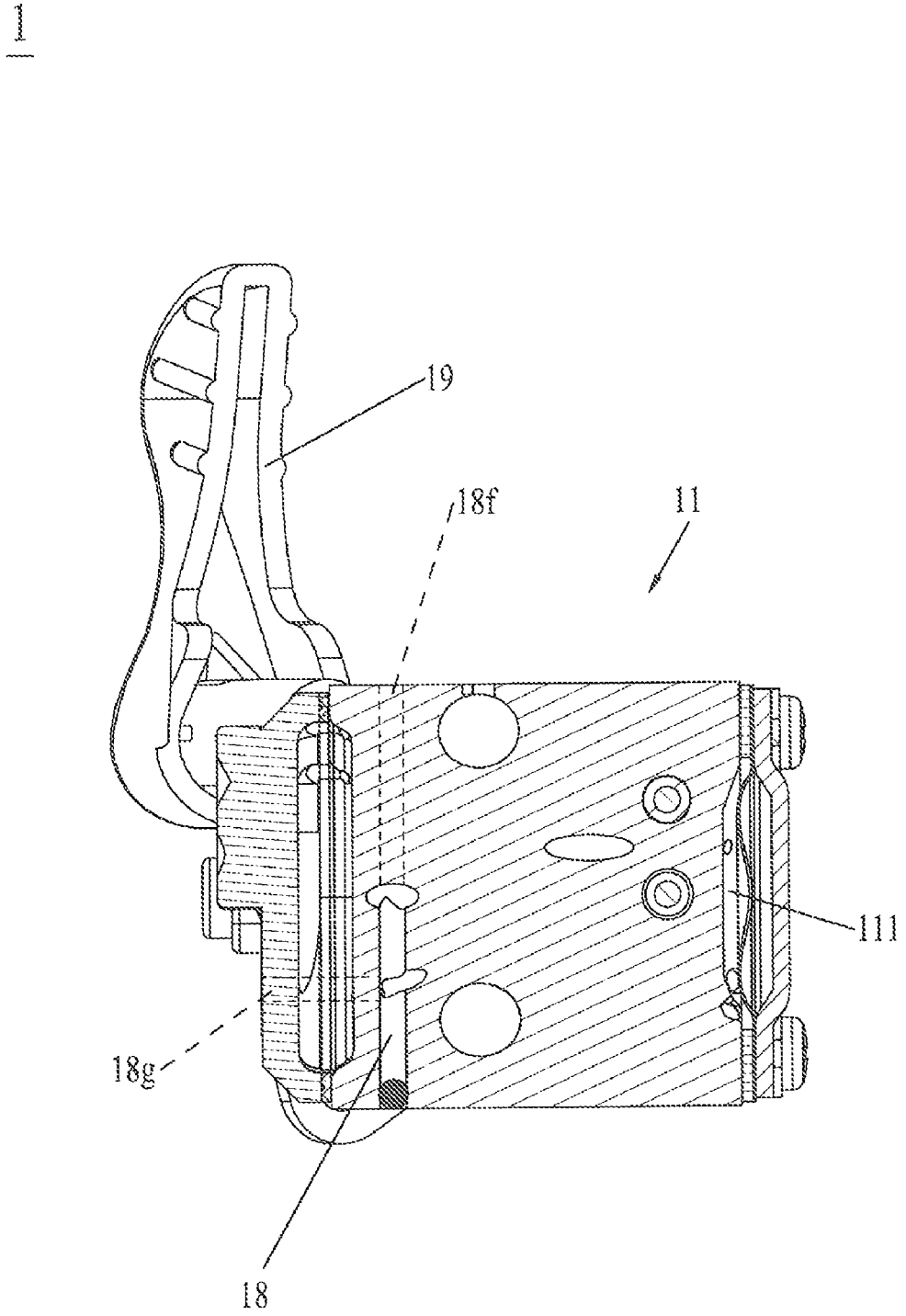
Figure 6E:
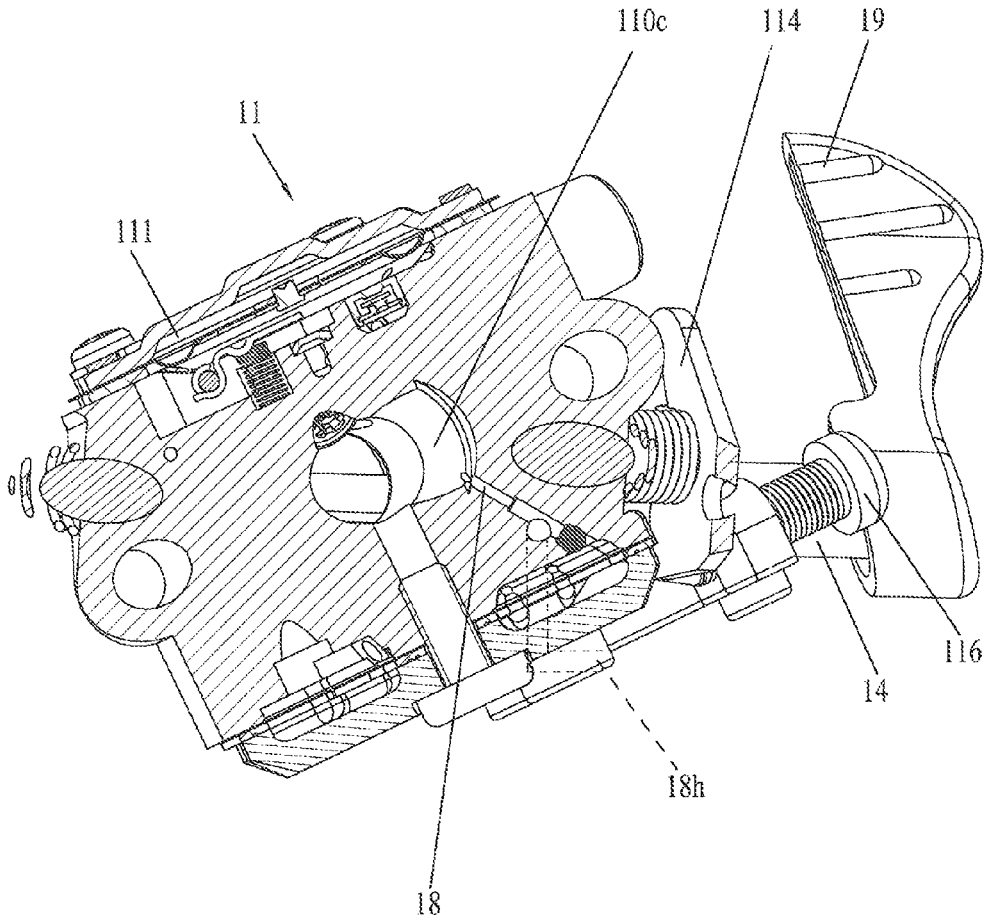
Figure 7:
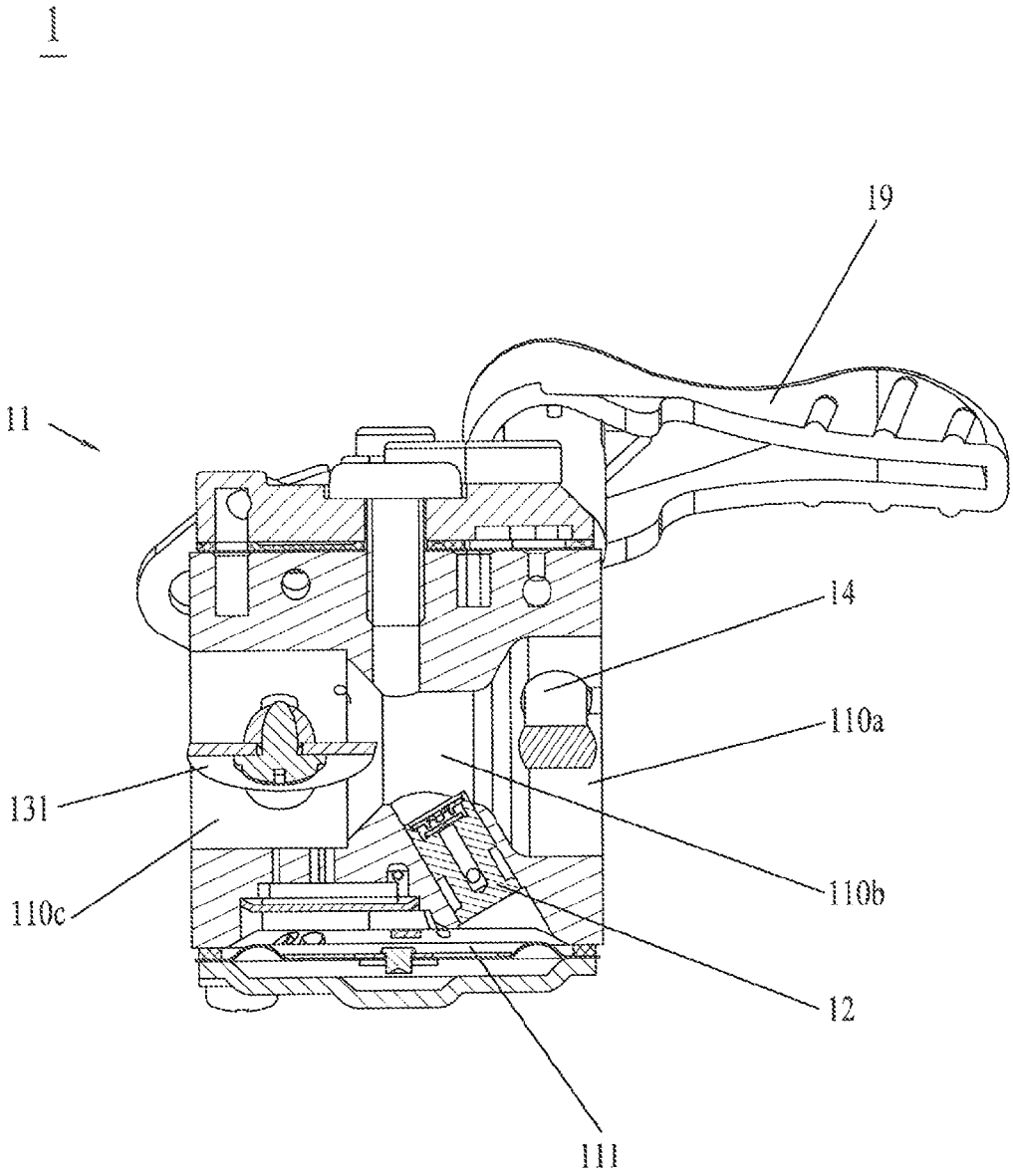
FIG. 7 is a state diagram of the engine works normally carburetor shown in FIG. 3 when the engine works normally.

In conjunction with FIG. 3-7, the work principle of the simple start diaphragm carburetor of the present invention will be illustrated in detail. When the engine starts, starting handle 19 is rotated along a direction as denoted by the arrow I shown in FIG. 3, the upper position of the choke spindle 14 which is pressed against the valve body 152 of the first linkage subassembly 15 is rotated towards the lower position, and the starting handle 19 drives the first eccentric element 161 of the second linkage subassembly 16 which is fixed to the linkage end 14*a* of the choke spindle 14 to rotate then push the second eccentric element 162 which is fixed to the linkage end 132*a* of the throttle spindle 132. When the choke spindle 14 rotates from the upper position to the lower position, due to the distance from the lower position to the axes of the choke spindle 14 is smaller than the distance from the upper position to the axes of the choke spindle 14, the valve body 152 of the first linkage subassembly 15 can slip in the receiving cavity 112 of the carburetor body 11 by the elastic element 151. When the slipping valve body 152 open the start fuel passage 18 gradually, the choke spindle 14 drives the pushing portion 163 of the first eccentric element 161 to press against the resisting portion 164 of the second eccentric element 162 gradually and slip along the resisting portion 164, such that the throttle spindle 132 fixed with the second eccentric element 162 drives the throttle 131 to open the main fuel supply channel 110 gradually. When the lower position of the choke spindle 14 presses against the valve body 152 completely, the valve body 152 is pushed to slip along the receiving cavity 112 by the elastic element 151, thereby open the start fuel passage 18, at the same time, the pushing portion 163 of the first eccentric element 161 fixed on the choke spindle 14 push the second eccentric element 162 to rotate and then is locked at the resisting portion 164 of the second eccentric, while, the second eccentric element 162 drives the throttle 131 to open the main fuel supply channel 110 partially. After opening the start fuel passage 18, due to the stress produced in the measuring room 111 is bigger than that produced in the mixing cavity 110*c*, the fuel in the measuring room 111 enters the start fuel passage 18 shown in FIG. 5*a* and flows along the direction of arrow in the start fuel passage 18 shown in FIG. 5*a*, then passes through the passage formed of the broken line as denoted by the numeral 18*a* in FIG. 5*a* and flows towards the passage formed of the broken line as denoted by the numerals 18*b* in FIG. 5*b*. The fuel which flows into the passage formed of the broken line as denoted by the numerals 18*b* in FIG. 5*b* passes through the receiving cavity 112 and then flows out along the direction of arrow in the passage formed of the broken line as denoted by the numerals 18*c* in FIG. 5*c*. While, the fuel which flows out of the passage formed of the broken line as denoted by the numerals 18*c* in FIG. 5*c* flows into the passage formed of the broken line as denoted by the numerals 18*d* in FIG. 5*c* again, and flows out along the direction of arrow in the passage formed of the broken line as denoted by the numerals 18*e* in FIG. 5*c*, while, the fuel which flows out of the passage formed of the broken line as denoted by the numerals 18*e* in FIG. 5*c* flows into the passage formed of the broken line as denoted by the numerals 18*f* in FIG. 5*d* again, and then flows out along the direction of arrow in the passage formed of the broken line as denoted by the numerals 18*g* in FIG. 5*d*, at last, enters the passage formed of the broken line as denoted by the numerals 18*h* in FIG. 5*e* and then passes through the fuel outlet of the start fuel passage 18 to enter the mixing cavity 110*c* so as to increase the quantity of the fuel. Meanwhile, the main fuel supply channel 110 opened partially makes the fuel ejected from the main adjutage 12 and the air in the gas inlet cavity 110*a* partially flow into the mixing cavity 110*c*, thereby the engine starts at a high intensity fuel state so as to increase the probability of successful start of the engine. After starting, the engine needs as prolonged warm-up. Due to the resisting portion 164 of the second eccentric element 162 is locked at the pushing portion 163 of the first eccentric element 161, after loosening the starting handle 19, the first eccentric element 161 is still locked at the second eccentric element 162, thus the throttle 131 opens the main fuel supply channel 110 partially and the choke makes the start fuel passage 18 be open state, under the state that the main fuel supply channel 110 is opened partially and the start fuel passage 18 is opened, the air can enter the main fuel supply channel 110 without any limitation, thereby meeting the need of a prolonged warn-up of the engine after starting. When the engine works normally, rotate the throttle spindle 132, drive the throttle 131 to open the main fuel supply channel 110 sequentially and rotate the second eccentric element 162 together, the rotating second eccentric element 162 makes its resisting portion 164 be divorced from the pushing portion 163 of the first eccentric element 161, furthermore, under the effect of the reset element 17, the first eccentric element 161 is reset with the reset of the choke, the resetting choke makes its upper position press against the valve body 152 of the first linkage subassembly 15, and conquer the elastic force produced by the elastic element 151 of the first linkage subassembly 15 thereby pushing the valve body 152 to slip in the receiving cavity 112, the slipping valve body 152 closes the start fuel passage 18, thus make the simple start diaphragm carburetor of the present invention be the state shown in FIG. 7. While the start fuel passage 18 is closed in the receiving cavity 112, thus the fuel which enters the passage formed by the broken line as denoted by the numerals 18*b* in FIG. 8 can not flow out along the direction of arrow in the passage formed of the broken line as denoted by the numerals 18*c* in FIG. 6*b*, thereby satisfying the need of normal work of the engine.

The simple start diaphragm carburetor of the present invention includes the start fuel passage 18, the first linkage subassembly 15, the second linkage subassembly 16 and the reset clement 17. When the engine starting, the choke spindle 14 opens the start fuel passage 18 by the first linkage subassembly 15, and at the same time, also drives the throttle spindle 132 to rotate by the second linkage subassembly 16, while the rotating throttle spindle 132 drives the throttle 131 to open the main fuel supply channel 110 partially, so as to cause the engine to start at a high intensity fuel state, thereby increasing the probability of the successful start of the engine. After starting, the second linkage subassembly 16 makes the choke spindle 14 and the throttle spindle 132 maintain an original state, such that the main fuel supply channel 110 is maintained at a partial open state and the start fuel passage 18 is maintained at an open state. Thus, the air can enter the main fuel supply channel 110 without any limitation, thereby meeting the need of a prolonged warn-up of the engine after starting. When rotating the throttle spindle 132 to make it open the main fuel supply channel 110 to meet the need of normal work of the engine, the second eccentric element 162 which is fixed with the linkage end 132*a* of the throttle spindle 132 is divorced from the linkage with the first eccentric element 161, the first eccentric element 161 divorced from the linkage is reset automatically under the effect of the reset element 17, thus the trouble produced by exciting diaphragm carburetor that it needs to rotate the choke spindle 14 by manual means after the engine starting is avoided, thereby reducing the burden of the user.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A simple start diaphragm carburetor comprising:

a carburetor body, which is formed to be a main fuel supply channel comprising a gas inlet cavity, a venturi and a mixing cavity;

a main adjutage, which is mounted on the venturi;

a throttle subassembly, which comprises a throttle and a throttle spindle, the throttle is mounted in the mixing cavity and fixedly connects with the throttle spindle which is pivoted to the carburetor body hermetically, two ends of the throttle spindle protrude from the carburetor body to form a linkage end and a mounting end, respectively; and a rounded choke spindle, which is pivoted to a part of the carburetor body located at the gas inlet cavity hermetically, two ends of the choke spindle protrude from the carburetor body to form a linkage end and a fixing end, respectively;

wherein the carburetor further comprises a linkage subassembly and a start fuel passage provided in the carburetor body for starting, a fuel inlet of the start fuel passage connects with a measuring room provided in the carburetor body, a fuel outlet of the start fuel passage connects with the mixing cavity, the linkage subassembly comprises a first linkage subassembly, a second linkage subassembly and a reset element, the carburetor body further comprises a receiving cavity which connects with the start fuel passage, the first linkage subassembly is contained in the receiving cavity smoothly and hermetically, one end of the first linkage subassembly is elastically pressed against a part of the carburetor body which is in the receiving cavity, the other end of the first linkage subassembly is pressed against the choke spindle, the second linkage subassembly comprises a first eccentric element mounted on the linkage end of the choke spindle and a second eccentric element fixed on the linkage end of the throttle spindle, the second eccentric element cooperates with the first eccentric element to form a linkage, the reset element is pressed between the first eccentric element and the carburetor body, wherein the choke spindle is started and rotated to cause the first linkage subassembly to open the start fuel passage and cause the second linkage subassembly to open the main fuel supply channel partially, rotate the throttle spindle to cause the choke spindle to be reset by the reset element thereby closing the start fuel passage.

2. The carburetor as claimed in claim 1, wherein the first eccentric element of the second linkage subassembly has a protuberant pushing portion, and the second eccentric element has a cambered resisting portion cooperating with the pushing portion to form a linkage.

3. The carburetor as claimed in claim 2, wherein the pushing portion is a column, and the resisting portion is step shaped.

4. The carburetor as claimed in claim 1, wherein the first eccentric element of the second linkage subassembly has a cambered locating slot formed therein, the carburetor body has a locating column corresponding to the locating slot, the locating column extends into the locating slot.

5. The carburetor as claimed in claim 1, wherein the first linkage subassembly comprises a elastic element and a valve body, one end of the elastic element is pressed against the part of the carburetor body which is in the receiving cavity, the other end of the elastic element is pressed against one end of the valve body which is contained in the receiving cavity smoothly and hermetically, the other end of the valve body is pressed against the choke spindle which has a upper position pressed against the valve body to close the start fuel passage and a lower position pressed against the valve body to open the start fuel passage.

6. The carburetor as claimed in claim 5, wherein the choke spindle has a hollow plane formed within, the distance from the hollow plane to the axes of the choke spindle is smaller than the distance from the rounded surface of the choke spindle to the axes of the choke spindle thereby forming the upper position and the lower position, respectively.

7. The carburetor as claimed in claim 1, wherein the reset element is a spring.

8. The carburetor as claimed in claim 1, further comprises a starting handle which is fixed on the fixing end of the choke spindle.

* * * * *